US008658578B2

(12) United States Patent
Hsin et al.

(10) Patent No.: US 8,658,578 B2
(45) Date of Patent: Feb. 25, 2014

(54) LUBRICATING OIL COMPOSITION AND METHOD FOR MANUFACTURING THE SAME

(75) Inventors: Yu-Lin Hsin, Tainan County (TW); Mei Hua Wang, Miaoli County (TW); Chih Kuang Chang, Tainan (TW); Ting-Yao Su, Pingtung County (TW)

(73) Assignee: Industrial Technology Research Institute, Hsinchu (TW)

( * ) Notice: Subject to any disclaimer, the term of this patent is extended or adjusted under 35 U.S.C. 154(b) by 197 days.

(21) Appl. No.: 13/151,041

(22) Filed: Jun. 1, 2011

(65) Prior Publication Data

US 2012/0172267 A1 Jul. 5, 2012

(30) Foreign Application Priority Data

Dec. 29, 2010 (CN) ..... 2010 1 0623959
Dec. 30, 2010 (TW) ..... 99146827 A

(51) Int. Cl.
*C10M 169/04* (2006.01)
*C10M 145/14* (2006.01)

(52) U.S. Cl.
USPC ..... 508/469; 508/116

(58) Field of Classification Search
USPC ..... 508/116, 469
See application file for complete search history.

(56) References Cited

U.S. PATENT DOCUMENTS

| | | | | |
|---|---|---|---|---|
| 2003/0228249 | A1 | 12/2003 | Fujimura et al. | |
| 2004/0096705 | A1 | 5/2004 | Homola | |
| 2004/0214159 | A1 | 10/2004 | Fujimura et al. | |
| 2005/0008560 | A1 | 1/2005 | Kataoka et al. | |
| 2005/0065044 | A1* | 3/2005 | Migdal et al. | 508/230 |
| 2005/0142990 | A1 | 6/2005 | Homola | |
| 2005/0220829 | A1 | 10/2005 | Sung et al. | |
| 2006/0147644 | A1 | 7/2006 | Fujimura et al. | |
| 2006/0241236 | A1 | 10/2006 | Kuznetsov et al. | |
| 2006/0252033 | A1 | 11/2006 | Fujimura et al. | |
| 2007/0184121 | A1 | 8/2007 | Sung | |
| 2007/0231245 | A1 | 10/2007 | Kumasaka et al. | |
| 2007/0231611 | A1 | 10/2007 | Masaki | |
| 2007/0254817 | A1 | 11/2007 | Griffo et al. | |
| 2008/0127475 | A1 | 6/2008 | Griffo | |
| 2008/0188165 | A1 | 8/2008 | Sakaguchi et al. | |
| 2008/0248979 | A1* | 10/2008 | Nakagawa et al. | 508/128 |
| 2008/0249229 | A1* | 10/2008 | Lukehart et al. | 524/496 |
| 2008/0315453 | A1 | 12/2008 | Molitor et al. | |
| 2008/0318026 | A1 | 12/2008 | Dai et al. | |
| 2009/0038858 | A1 | 2/2009 | Griffo et al. | |
| 2009/0042751 | A1 | 2/2009 | Narayan | |
| 2009/0056802 | A1 | 3/2009 | Rabani | |
| 2009/0130031 | A1 | 5/2009 | Herman | |
| 2009/1013062 | | 5/2009 | Herman | |
| 2009/0187155 | A1 | 7/2009 | Razavi | |
| 2009/0188170 | A1 | 7/2009 | Kumasaka et al. | |
| 2009/1021482 | | 8/2009 | West et al. | |
| 2009/0283718 | A1 | 11/2009 | Yao | |
| 2010/0029518 | A1* | 2/2010 | Markovitz et al. | 508/113 |
| 2010/0037530 | A1 | 2/2010 | Yoshida et al. | |
| 2010/0069513 | A1 | 3/2010 | Fujimura et al. | |
| 2010/0092728 | A1 | 4/2010 | Hasegawa et al. | |
| 2010/0119815 | A1 | 5/2010 | Kim | |
| 2010/0129615 | A1 | 5/2010 | Chizik et al. | |

FOREIGN PATENT DOCUMENTS

| | | | |
|---|---|---|---|
| CN | 1380363 | A | 11/2002 |
| CN | 1439451 | A | 9/2003 |
| CN | 1695779 | A | 11/2005 |
| CN | 1696258 | A | 11/2005 |
| CN | 101016496 | A | 8/2007 |
| CN | 101205500 | A | 6/2008 |
| EP | 1 953 214 | A1 | 8/2008 |
| JP | 8-20786 | | 1/1996 |
| TV | I276706 | | 3/2007 |
| TW | 577933 | | 3/2004 |
| TW | 200422445 | | 11/2004 |
| TW | 200533379 | | 10/2005 |
| TW | 200841993 | | 4/2007 |
| TW | I286600 | | 9/2007 |
| TW | 200736164 | | 10/2007 |
| TW | 200841996 | | 11/2008 |
| TW | 200844120 | | 11/2008 |
| TW | 200844149 | | 11/2008 |
| TW | 200844155 | | 11/2008 |
| TW | I313308 | | 8/2009 |

OTHER PUBLICATIONS

Hsiao Y. Chu et al., "The anti-scuffing performance of diamond nano-particles as an oil additive" Wear (2010), doi: 10.1016/j.wear.2009.12.023, pp. 1-8.

Mingwu Shen et al., "The Tribological Properties of Oils Added with Diamond Nano-Particles ©" Tribology Transactions, vol. 44 (2001) 3, pp. 494-498.

Anna Valeryevna et al., "Diamond Powders Less than 100 nm in Diameter as Effective Solid Lubricants in Vacuum" Japanese Journal of Applied Physics, vol. 43, No. 7A, 2004, pp. L920-L923.

* cited by examiner

*Primary Examiner* — Prem C Singh
*Assistant Examiner* — Francis C Campanell
(74) *Attorney, Agent, or Firm* — Muncy, Geissler, Olds & Lowe, P.C.

(57) ABSTRACT

The disclosure provides a lubricating oil composition and method for manufacturing the same. The lubricating oil composition substantially consists of a base lubricant oil, and an organic-inorganic composite particle uniformly dispersed in the base lubricant oil. This lubricating oil composition is applicable to a sliding section or sliding member of an automotive internal combustion engine or power transmission apparatus to significantly reduce friction coefficient, temperature of oil and wear rate.

15 Claims, 11 Drawing Sheets

LUBRICATING OIL COMPOSITION AND METHOD FOR MANUFACTURING THE SAME

CROSS REFERENCE TO RELATED APPLICATIONS

This application is based upon and claims the benefit of priority from the prior China Patent Application No. 201010623959.2, filed on Dec. 29, 2010, the entire contents of which are incorporated herein by reference. Further, this application is also based upon and claims the benefit of priority from the prior Taiwan Patent Application No. 099146827, filed on Dec. 30, 2010, the entire contents of which are incorporated herein by reference.

BACKGROUND

1. Technical Field

The disclosure relates to a lubricating oil composition and method for manufacturing the same, and in particular relates to a lubricating oil composition in the absence of a dispersant (or surfactant) and method for manufacturing the same.

2. Description of the Related Art

Environmental pollution is one of the most-discussed issues in the world today. In particular, $CO_2$ content in the atmosphere is considered one of the causes for global warming. An improvement in operating efficiency of a machine can directly lead to energy savings and indirectly reduce the emission of carbon dioxide. The improvement of operating efficiency a machine can be achieved by effectively lowering the frictional losses in mechanical devices by providing a low coefficient of friction, and lubricating oils have been found to be useful in reducing friction in mechanical devices. The improvement in efficiency depends primarily on the friction properties of the lubricating oil. Further, lubricating additives can be incorporated into the lubricating oil for further improving the friction properties thereof.

The advanced commercially available lubricating additives include organic compound contained sulfur, phosphorous and chloride, such as molybdenum dithiocarbamate (MoDTC) or molybdenum dithiophosphate (MoDTP) as disclosed in Japanese Patent Provisional Publication No. 8-20786. However, those additives have disadvantages of low thermal and pressure resistances, and short lifetime and cause an environmental contamination problem.

To the contrary, inorganic solid additives, such as graphite, molybdenum disulfide, or nanodiamond, exhibit high thermal and pressure resistances and durability. However, since molybdenum disulfide easily be oxidized and causes an environmental contamination problem, the use of molybdenum disulfide has been prohibited by law in recent years. Further, due to the large size, graphite additives are apt to cause precipitation and consequently result in blocking.

Ultra dispersed diamond (UDD) is a structural combination of a diamond core and graphite layer surface and can be fabricated by detonation method. The ultra disperse diamonds have particle sizes between 4 to 6 nm, and surfaces of the ultra disperse nano-diamonds are covered by a fullerene-like carbon, which aggregates into particles of hundreds of nanometers in diameter. The ultra dispersed diamonds are not only hard, they also have extremely high thermal conductivity, high wear-resistance, and good chemical stability, but they also have large surface areas (280~420 $m^2/g$) and high surface activities. Ultra dispersed diamonds have been proposed to be used as a lubricating additive. It is often desirable to improve the dispersion of the ultra dispersed diamonds in solvents in order to increase their applicability. However, ultra dispersed diamonds easily aggregate to micro size, and lose their unique features as nano-particles due to the high specific surface energy. The aggregated ultra dispersed diamonds have size of more than several micrometers, thereby exhibiting inferior mobility, friction, and dispersibility properties.

In China Patent Application No. 02115230.6, nano-diamonds were modified by a specific silane reagent. Although the method improved the stability of the nano-diamonds in medium, the cost of the silane reagent is high, and the reaction time is long, thus, limiting industrial applications. In another example such as China Patent Application No. 02139764.3, surfactant was added into nano-diamonds by gas flow pulverization, high pressure liquid flow pulverization, or bead milling. By physical pulverization or mechanical milling, the nano-diamonds were equally dispersed into a solution. However, because the surfactant is absorbed on the surface of the nano-diamonds, the nano-diamonds can only be dispersed into some specific solvents, and therefore, the applications thereof are limited.

U.S. Pat. Pub. No. 2008248979A1 discloses a lubricant composition, including diamond nano-particles and dispersants, can reduce friction coefficient. The diamond nano-particles can be dispersed in lubricating oil by physisorption effect in the presence of a dispersant. However, a dispersant added in an excess amount would detrimentally affect the friction properties thereof, and the physisorption effect is apt to be unstable under a high temperature. Therefore, after prolonged operation, the ultra dispersed diamonds re-aggregate to a agglomeration, having a micro size, due to desorption of dispersant under a high temperature. The aggregation not only reduces friction properties but also causes machines to be scratched.

Accordingly, it is highly desirable to develop an effective technique to stably disperse the ultra dispersed diamond into base oil in the absence of a dispersant (or surfactant).

SUMMARY

An exemplary embodiment of a lubricating oil composition including a base lubricant oil, and an organic-inorganic composite particle uniformly dispersed in the base lubricant oil.

Further, the disclosure also provides a method for preparing the aforementioned lubricating oil composition, including: mixing a nanodiamond particle with a monomer, thereby obtaining a first mixture; subjecting the first mixture to a de-aggregation and polymerization process, thereby obtaining a nanodiamond particle with the polymeric chains grafted on a surface of the nanodiamond particle; mixing the nanodiamond particle with the polymeric chains grafted on the surface of the nanodiamond particle with a base lubricant oil, obtaining a second mixture; and subjecting the second mixture to a dispersion process.

A detailed description is given in the following embodiments with reference to the accompanying drawings.

BRIEF DESCRIPTION OF THE DRAWINGS

The disclosure can be more fully understood by reading the subsequent detailed description and examples with references made to the accompanying drawings, wherein.

DETAILED DESCRIPTION

Due to the addition of the dispersant (or surfactant), the conventional lubricating oil composition has inferior durability and unstable lubricating properties. The disclosure provides a lubricating oil composition and a method for preparing the same. The lubricating oil composition of the disclosure, including a base lubricant oil and an organic-inorganic composite particle uniformly dispersed in the base lubricant oil, can exhibit excellent lubricating properties in the absence of a dispersant (or surfactant). Particularly, the organic-inorganic composite particle of the lubricating oil composition includes outside polymeric chains chemically compatible with the base lubricant oil, and inside inorganic nanodiamond improving the durability of the lubricating oil composition The organic-inorganic composite particles of the lubricating oil composition can be uniformly dispersed in a base lubricant oil after long periods of operation, and is applicable to a sliding section or sliding member of an automotive internal combustion engine or power transmission apparatus to significantly reduce friction coefficient, temperature of oil and wear rate.

In one embodiment, the lubricating oil composition of the disclosure substantially consists of a base lubricant oil, and an organic-inorganic composite particle uniformly dispersed in the base lubricant oil. Particularly, the organic-inorganic composite particles can be uniformly dispersed in the base lubricant oil in the absence of a dispersant (or surfactant) after long periods of operation. The organic-inorganic composite particle can have a weight percentage of between 0.01% and 2% (100 ppm-20000 ppm), based on the total weight of the lubricating oil composition. Further, in another embodiment, the organic-inorganic composite particle can have a weight percentage of between 0.15% and 0.5% (1500 ppm-5000 ppm), based on the total weight of the lubricating oil composition.

Figure 1:
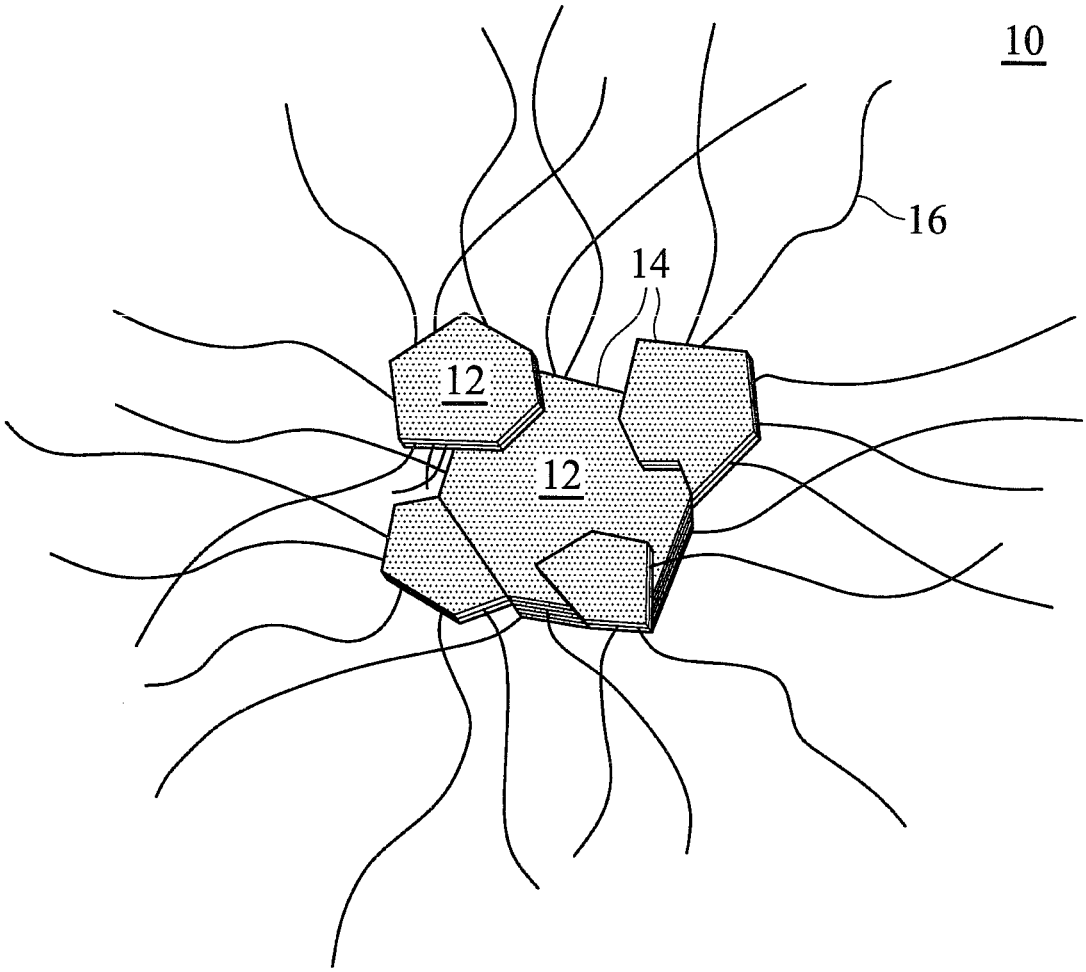
FIG. 1 shows a schematic diagram of the deaggregated organic-inorganic composite particle.

The base lubricant oil can include mineral oil, gear oil, semi-synthetic oil, synthetic oil, cutting oil, grease, or combinations thereof. FIG. 1 shows a schematic diagram of the deaggregated organic-inorganic composite particle. As shown in FIG. 1, the organic-inorganic composite particle 10 (with an average particular size of 10-250 nm) is a nanodiamond particle 12 including a polymeric chains 16 and graphite layers 14, wherein the polymeric chains 16 is grafted on the graphite layers 14 of the nanodiamond particle 12. Due to the outside polymeric chains 16, the nanodiamond particles 12 are not apt to aggregate to form a nanodiamond agglomeration (with a particular size of several micrometers). The polymeric chain can be a hydrophobic polymeric chain, such as polymethylmethacrylate (PMMA), poly(glycidyl methylacrylate (PGMA), polystyrene (PS), or combinations thereof. The polymeric chains can be selected depending on the polarity of the base lubricant oil, forcing the nanodiamond particle with the polymeric chains grafted thereon to be uniformly dispersed in the base lubricant oil over a long period of time. The polymeric chain has a weight percentage of between 4% and 50%, based on the weight of the organic-inorganic composite particle. In another embodiment, the polymeric chain has a weight percentage of between 15% and 40%, based on the weight of the organic-inorganic composite particle.

The method for preparing the organic-inorganic composite particle includes the following steps. First, a nanodiamond particle (such as ultra dispersed diamond (UDD)) and a monomer are mixed, obtaining a first mixture. The monomer is polymerized to form a polymeric chain and grafted on the nanodiamond particle, and can be methyl methacrylate, glycidylmethacrylate, styrene, or combinations thereof. The first mixture can further include a solvent including a polar solvent (such as ethanol or acetone) or non-polar solvent (such as toluene) depending on the polarity of the monomer. Next, the first mixture is subjected to a wet ball-milling process (de-aggregation process), and a free radical initiator is added into the first mixture simultaneously to perform polymerization of the monomer. Namely, in this step, a de-aggregation process is performed on the nanodiamond particle, and the polymeric chain (formed by polymerizing the monomer) is grafted on the nanodiamond particle simultaneously. The wet ball-milling process (de-aggregation process) employs zirconium beads with a diameter of between 15 and 200 μm, and the weight ratio between the zirconium beads and the nanodiamond particle is from 40:1 to 400:1. The free radical initiator can include a peroxide initiator or azo compound initiator, such as diethoxy acetophenone, benzophenone, benzyl benzoin isobutyl ether, benzyl dimethyl ketal, 1-hydroxycyclohexyl phenyl ketone, hraquinone, 2-hydroxy-2-methyl-1-phenylpropane-1-one, 1-(4-isopropylphenyl)-2-hydroxy-2-methylpropane-1-one, 2-methyl-[4-(meyhylthio)phenyl]-2-morpholino-1-propane, aromatic diazonium salts, triallysulfonium salts, diallyiodonium salts, triallylselenium salts of Lewis acid as well as metallocene compounds, or combinations thereof. The monomers are polymerized to form a polymeric chain in the presence of the initiator, and the polymeric chain is grafted on the graphite layer of the nanodiamond particle. The polymeric chain grafted on the graphite layer of the nanodiamond particle facilitates the dispersion of nanodiamond particle in the solvent. Therefore, the exposed graphite layer surface of the nanodiamond particle is increased, resulting in the polymeric chains being more apt to be grafted on the nanodiamond particle. After grafting with the polymeric chains, the nanodiamond particle can be dissolved in a solvent. The wet ball-milling process can have a milling rate of 10-20 m/s and a milling time of several hours. Next, the remaining monomers and polymers ungrafted onto nanodiamond are removed by centrifugation, obtaining the organic-inorganic composite particle. Finally, the organic-inorganic composite particle is mixed with a base lubricant oil to obtain a second mixture, and the second mixture can be further subjected to a dispersion process (such as ultrasonic vibration (with a vibration amplitude of 20-40 GHz), ball-miffing process (with a milling rate of 60-10000 rpm), or combinations thereof). If the dispersion process has a very low vibration amplitude (or very low milling rate), the organic-inorganic composite particle is not apt to uniform disperse in the base lubricant oil. To the contrary, if the dispersion process has a very high vibration amplitude (or very high milling rate), the polymeric chains of the organic-inorganic composite particle is apt to be degraded.

The following examples are intended to illustrate the disclosure more fully without limiting the scope of the disclosure, since numerous modifications and variations will be apparent to those skilled in this art.

Preparation of Organic-Inorganic Composite Particle

Example 1

Figure 2:
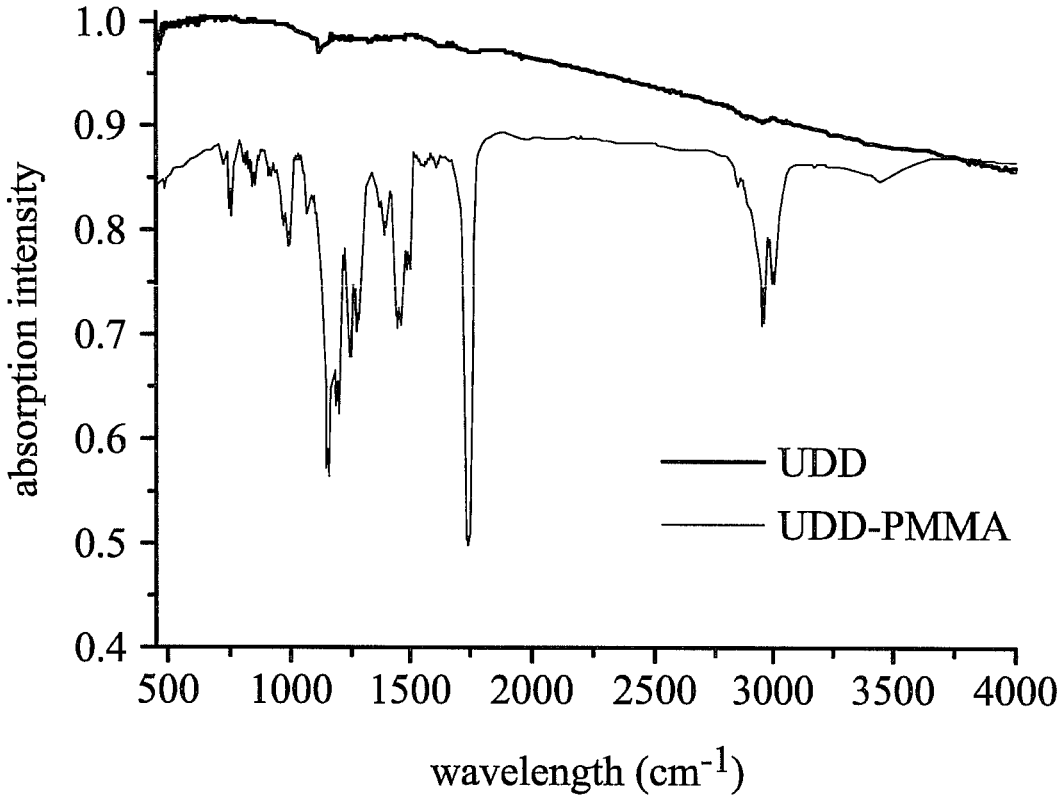
FIG. 2 shows the infrared absorption spectra of the UDD (pristine powder) and the UDD-PMMA (ultra dispersed diamond grafted with PMMA) of Example 1.

400 g of zirconium beads (with a diameter of 50 μm), 10 g of ultra dispersed diamond (sold and manufactured by ABBA group with the trade no. UDD), and 80 g of methylmethacrylate monomer were mixed and added into a milling chamber. The temperature of the circulating cooling system outside of the milling chamber was set in 80° C., and the milling rate of the milling chamber was set in 2400 rpm. During miffing, 10 g of benzoyl peroxide (dissolved in 10 ml of toluene) was added into the milling chamber with a flow rate of 5 ml/hr. The methylmethacrylate monomers were polymerized, and the obtained poly methylmethacrylate was grafted on the surface of the ultra dispersed diamond via the benzoyl peroxide initiator. Finally, the remaining monomer and solvent were removed by centrifugation, obtaining the ultra dispersed diamond with poly methylmethacrylate grafted on the surface thereof (UDD-PMMA). FIG. 2 shows the infrared absorption spectrum of the UDD-PMMA. The carbon-hydrogen stretch was determined from the IR absorption at 2980 $cm^{-1}$ and 2932 $cm^{-1}$; the carbon-hydrogen stretch of methylene was determined from the IR absorption at 1430-1470 $cm^{-1}$; the carbon-oxygen double bonds of ester was determined from the IR absorption at 1725 $cm^{-1}$; and the carbon-oxygen single bonds of ester was determined from the IR absorption at 1050-1300 $cm^{-1}$.

Figure 3:
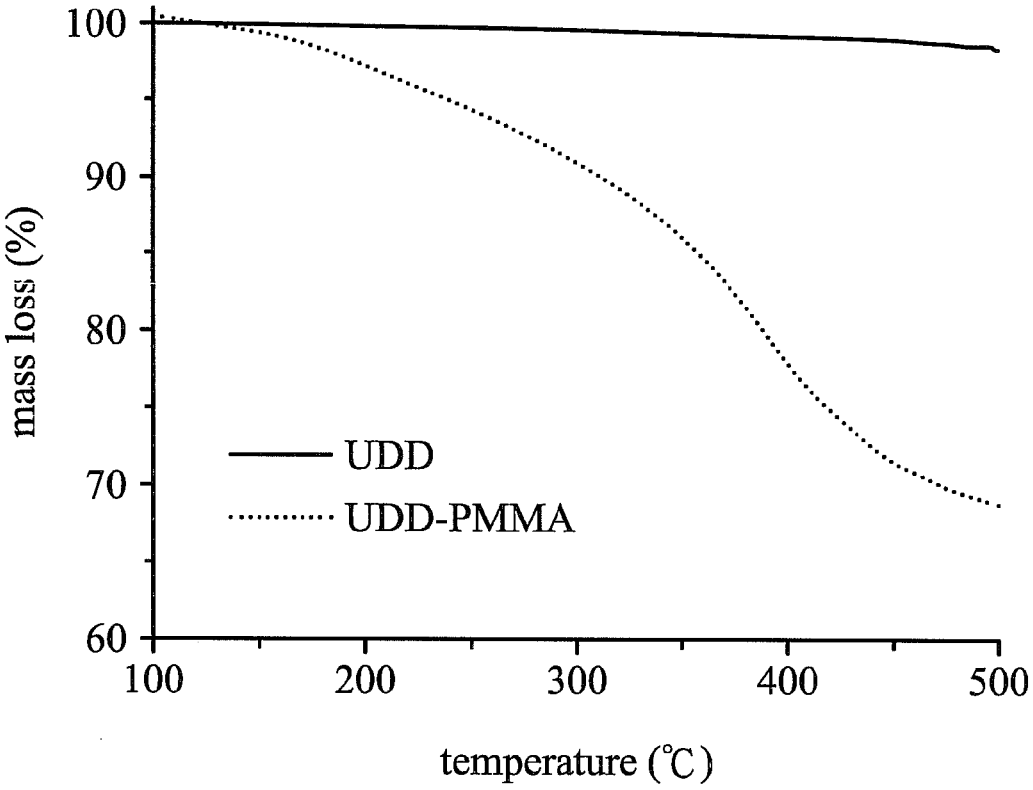
FIG. 3 shows thermogravimetric analysis (TGA) curves of the UDD (pristine powder) and the UDD-PMMA (ultra dispersed diamond grafted with PMMA) of Example 1.
Figure 5:
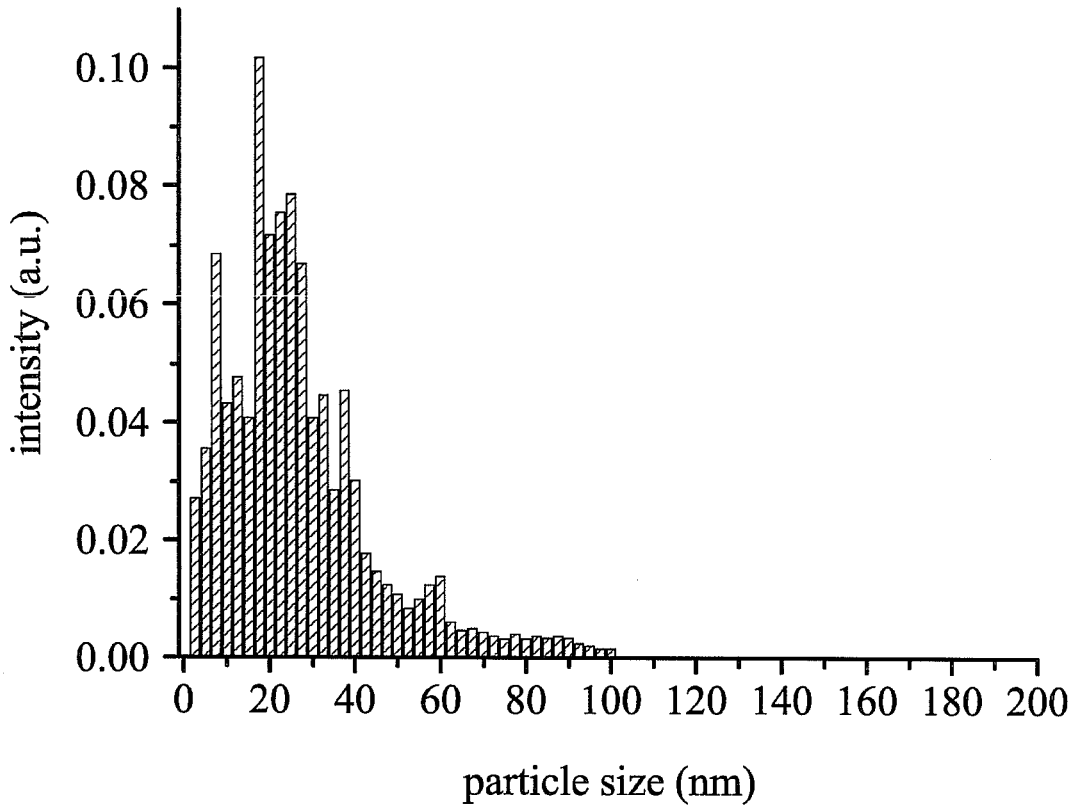
FIG. 5 is a graph showing the particle size distribution of the UDD-PMMA of Example 1.

Next, the polymeric chain weight ratio of the UDD-PMMA was measured using a thermogravimetric analyzer, and the results are shown in FIG. 3. As shown in FIG. 3, the majority of mass loss of the UDD-PMMA, which resulted from thermal decomposition of the PMMA polymeric, was between 200° C.-500° C., and the polymeric chain weight ratio of the UDD-PMMA was about 32%. FIG. 5 is a graph showing the particle size distribution of the UDD-PMMA, wherein the average particle size (d50) of the UDD-PMMA was about 20 nm.

Examples 2-3

Figure 4:
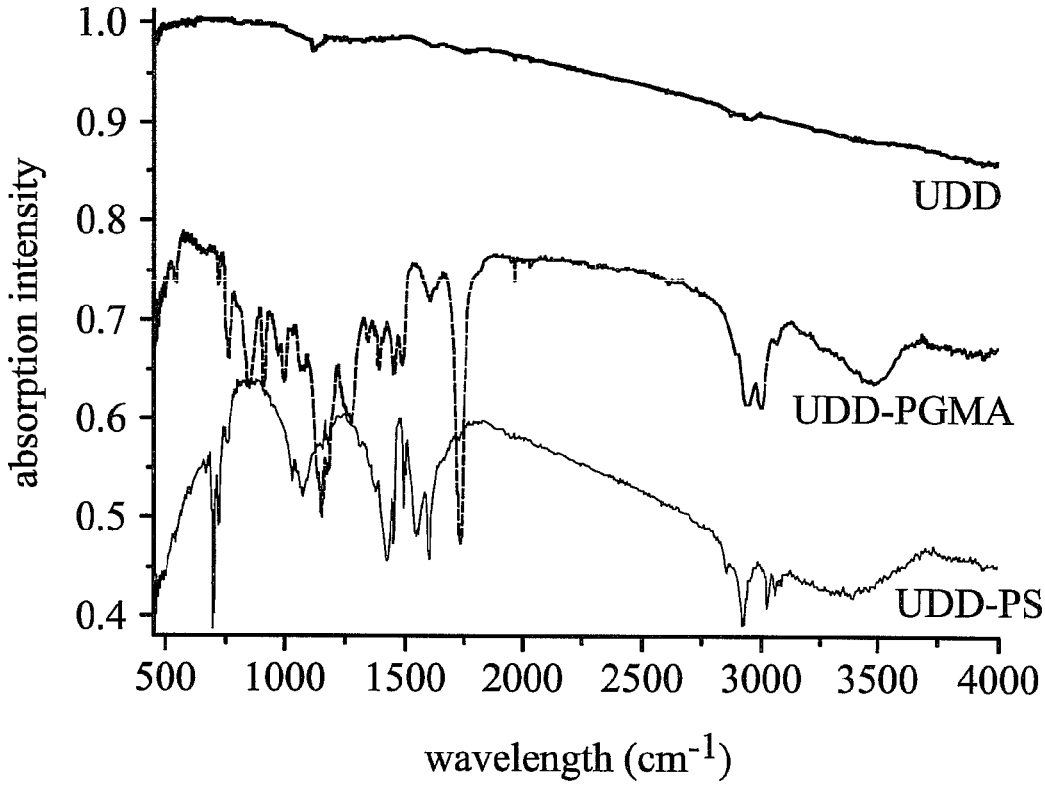
FIG. 4 shows the infrared absorption spectra of the UDD-PGMA (ultra dispersed diamond grafted with PGMA) as disclosed in Example 2 and the UDD-PS (ultra dispersed diamond grafted with PS) as disclosed in Example 3.

Example 2 was performed in the same manner as in Example 1 except that the monomer glycidyl methylacrylate was used instead of the monomer methyl methacrylate in Example 1, obtaining the ultra dispersed diamond with polyglycidyl methylacrylate grafted on the surface thereof (UDD-PGMA). Example 3 was performed in the same manner as in Example 1 except that the monomer styrene was used instead of the monomer methyl methacrylate in Example 1, obtaining the ultra dispersed diamond with polystyrene grafted on the surface thereof (UDD-PS). FIG. 4 shows the infrared absorption spectra of the UDD-PGMA as disclosed in Example 2 and the UDD-PS as disclosed in Example 3.

Figure 6:
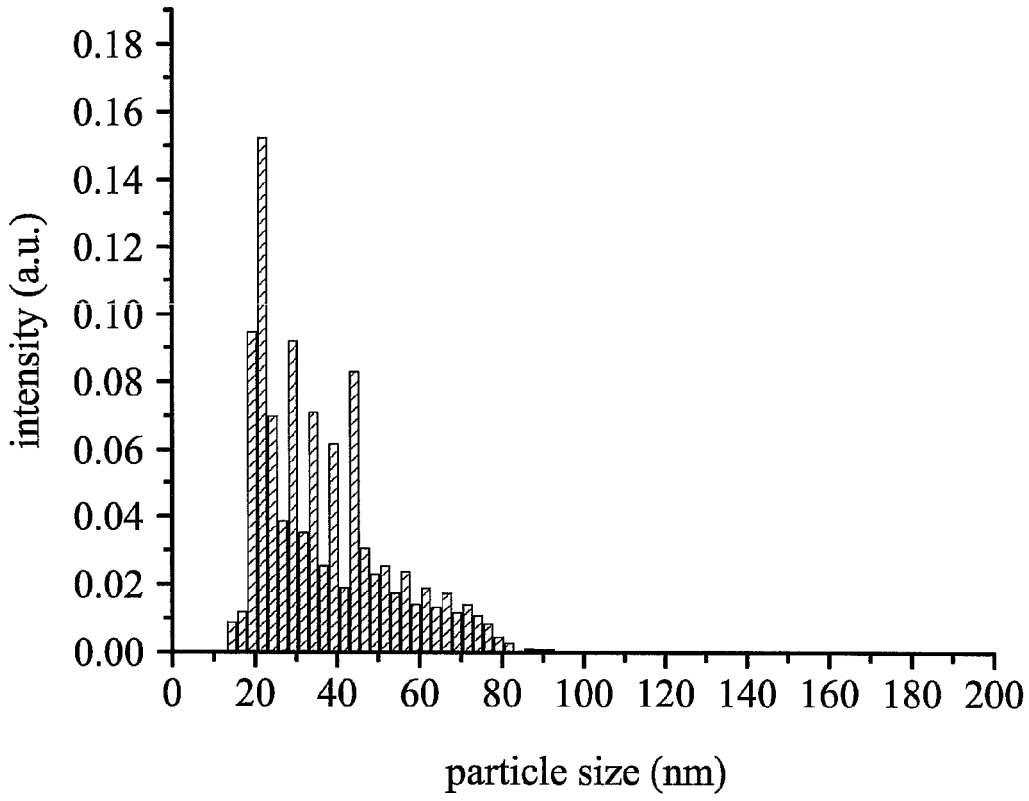
FIG. 6 is a graph showing the particle size distribution of the UDD-PGMA of Example 2.
Figure 7:
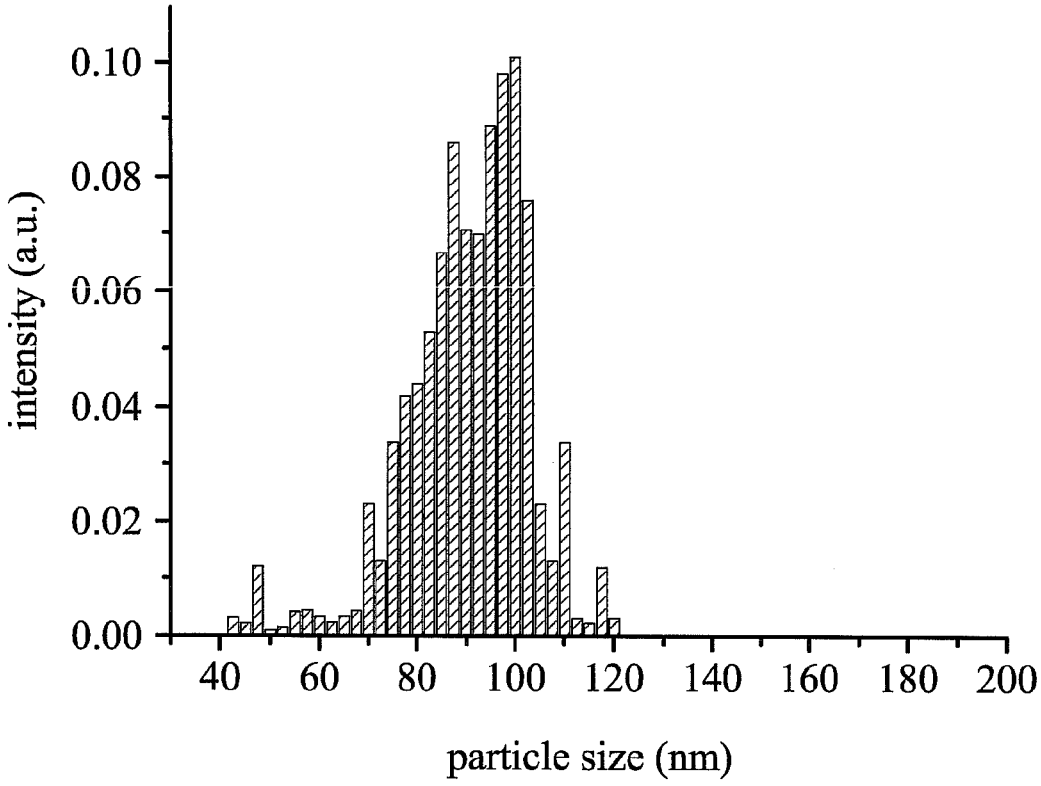
FIG. 7 is a graph showing the particle size distribution of the UDD-PS of Example 3.

FIG. 6 is a graph showing the particle size distribution of the UDD-PGMA of Example 2, wherein the average particle size (d50) of the UDD-PGMA was about 10 nm. FIG. 7 is a graph showing the particle size distribution of the UDD-PS of Example 3, wherein the average particle size (d50) of the UDD-PS was about 100 nm.

Preparation of Lubricating Oil Composition

Example 4

The UDD-PMMA of Example 1 was added into a base lubricant oil (sold and manufactured by CPC Corporation with the trade no. CPC R68) at concentrations of 0 ppm, 500 ppm, 1000 ppm, 1500 ppm, 2000 ppm, and 3000 ppm respectively. The friction coefficient, temperature of oil, and wear rate of the obtained lubricating oil compositions were measured via vans-on-ring simulation, and the results are shown in Table 1.

TABLE 1

| concentration of UDD-PMMA | friction coefficient | temperature of oil (° C.) | wear rate ($mm^3/m$) |
|---|---|---|---|
| 0 ppm UDD-PMMA | 0.2037 | 158.26 | 0.016195 |
| 500 ppm UDD-PMMA | 0.1430 | 145.40 | 0.005675 |
| 1000 ppm UDD-PMMA | 0.0990 | 139.44 | 0.004461 |
| 1500 ppm UDD-PMMA | 0.0580 | 73.07 | 0.004011 |
| 2000 ppm UDD-PMMA | 0.0570 | 68.05 | 0.0000051 |
| 3000 ppm UDD-PMMA | 0.0530 | 60.57 | 0.0000039 |

Figure 8:
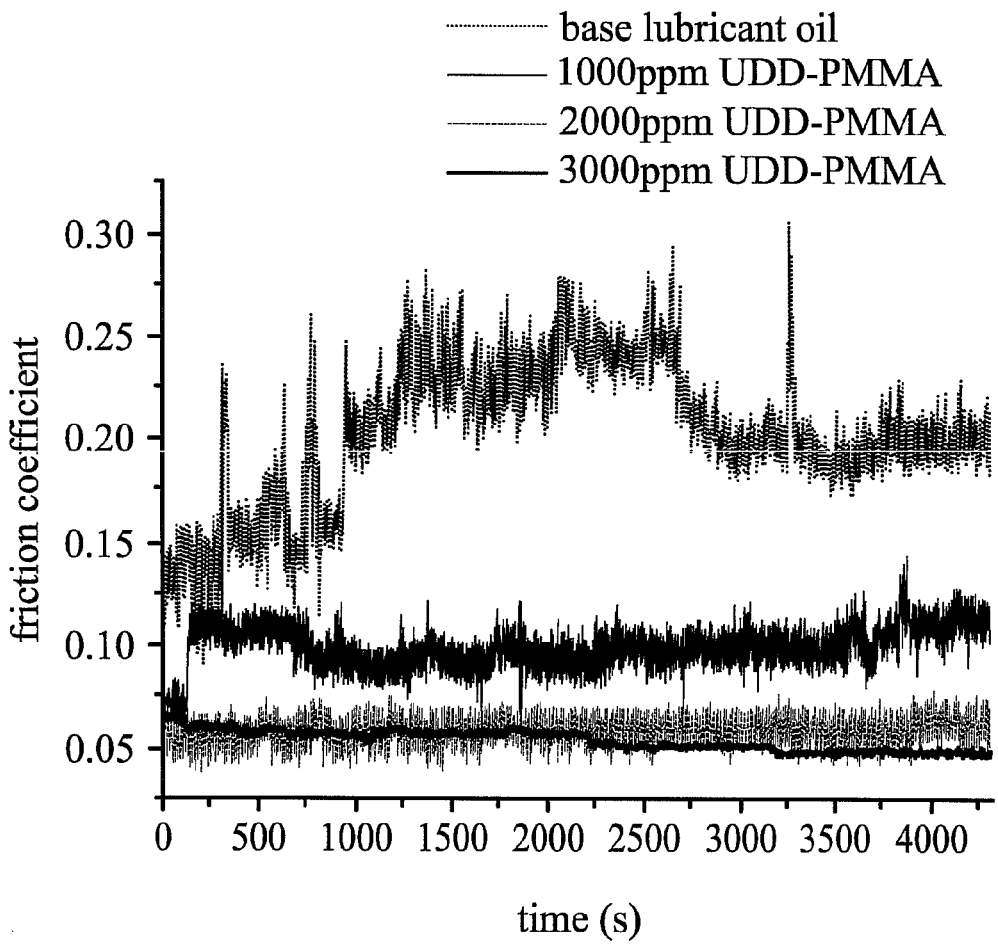
FIG. 8 is a graph plotting friction coefficient against operation time of the lubricating oil composition with various concentrations of Example 4.
Figure 9:
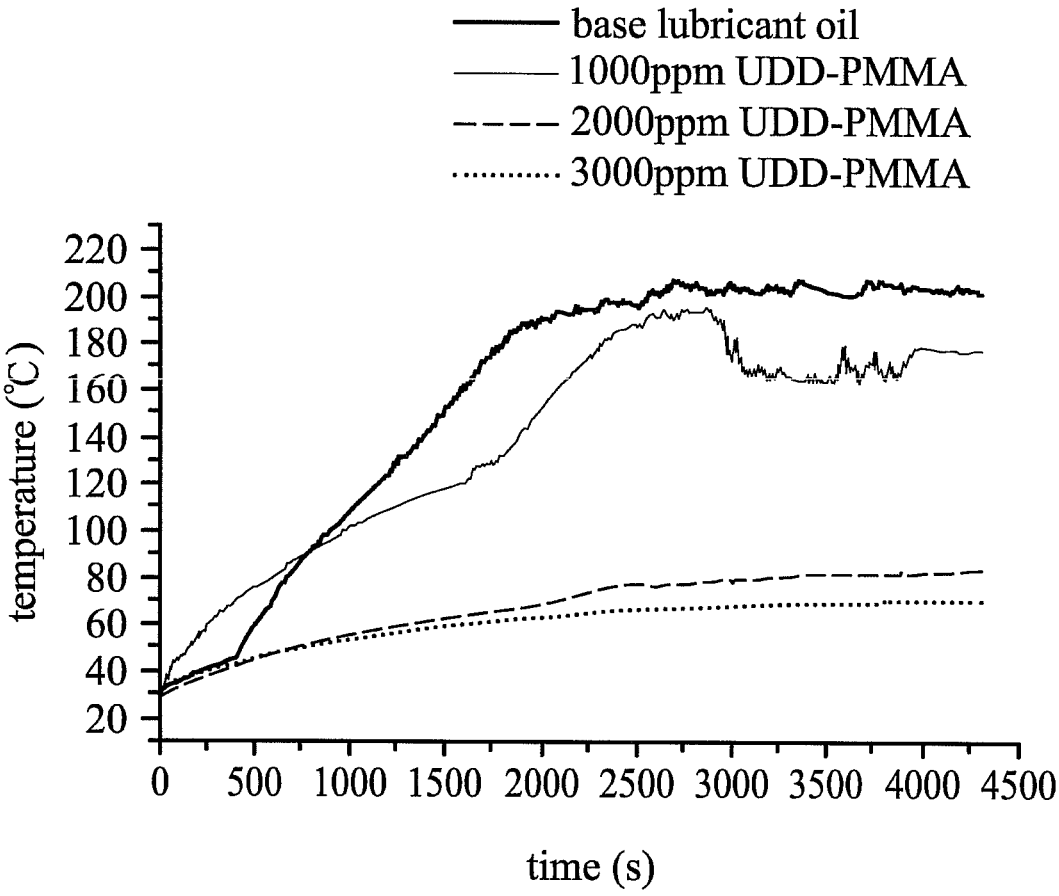
FIG. 9 is a graph plotting temperature of oil against operation time of the lubricating oil composition with various UDD-PMMA concentrations of Example 4.

Further, FIG. 8 is a graph plotting friction coefficient against operation time of the lubricating oil composition with various concentrations. FIG. 9 is a graph plotting temperature of oil against operation time of the lubricating oil composition with various UDD-PMMA concentrations.

The vans-on-ring simulation employed a Falex #6 testing machine, a data logger (Red Lion CSMSTRSX), and a Falex block (2.4 mm×4.8 mm×6.3 mm and made of SKD11 steel) with a roughness (Ra) of 0.044 μm. The slip rate of the block was set at 6.08 m/s, and the contact pressure was 4.33×106 Pa. The friction coefficient and temperature were measured every second, and the total operation time of the vans-on-ring simulation was 4320 seconds, and the total slip distance was 26283 meters.

Comparative Example 1

400 g of zirconium beads (with a diameter of 50 μm), 10 g of ultra dispersed diamond (sold and manufactured by ABBA group with the trade no. UDD), and 100 ml tetrahydrofuran (THF) were mixed and added into a milling chamber. The temperature of the circulating cooling system outside of the milling chamber was set in 80° C., and the milling rate of the milling chamber was set in 2400 rpm. During milling, 10 g of benzoyl peroxide (dissolved in 10 ml of toluene) was added into the milling chamber with a flow rate of 5 ml/hr. The methylmethacrylate monomers were polymerized, and the obtained poly methylmethacrylate was grafted on the surface of the ultra dispersed diamond via the benzoyl peroxide initiator. After removing the zirconium beads, a deaggregated nanodiamond particle was obtained.

Next, the deaggregated nanodiamond particle was added into a base lubricant oil (sold and manufactured by CPC Corporation with the trade no. CPC R68) at a concentration of 2000 ppm. Finally, a surfactant Span80 (sorbitol anhydride acid) was added into the mixture, wherein the ratio of the surfactant sorbitol anhydride was 2%, based on the total weight of the lubricating oil composition. After exposure to an ultrasonic vibration for 1 hour, a lubricating oil composition was obtained.

The friction coefficient, temperature of oil, and wear rate of the lubricating oil composition of the Comparative Example 1 were measured according to the vans-on-ring simulation as disclosed in Example 4. The results are in comparison with Example 4 and are shown in Table 2.

TABLE 2

| Sample | friction coefficient | temperature of oil (° C.) | wear rate ($mm^3/m$) |
|---|---|---|---|
| 2000 ppm UDD + 2% Spon80 | 0.093 | 145.9 | 0.0108 |
| 2000 ppm UDD-PMMA | 0.0570 | 68.05 | 0.0000051 |

Figure 10:
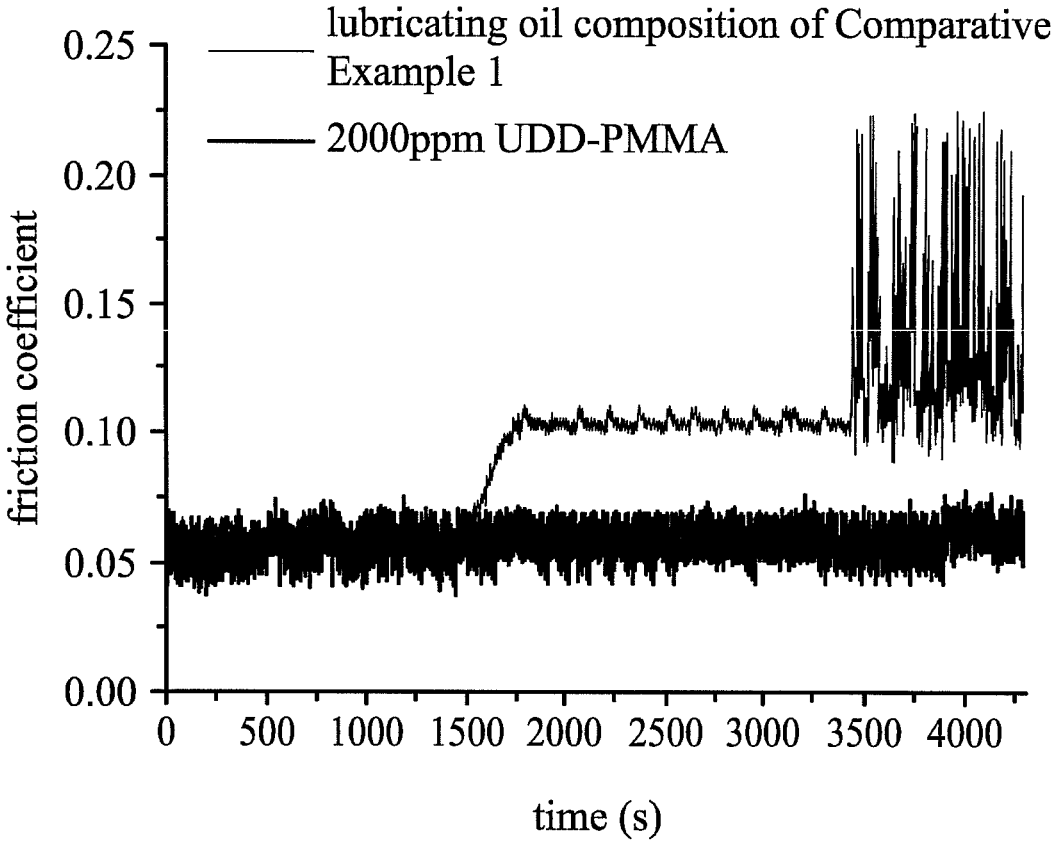
FIG. 10 is a graph plotting friction coefficient against operation time of the lubricating oil compositions as disclosed in the Comparative Example 1 and Example 4 (with a UDD-PMMA concentration of 2000 ppm).
Figure 11:
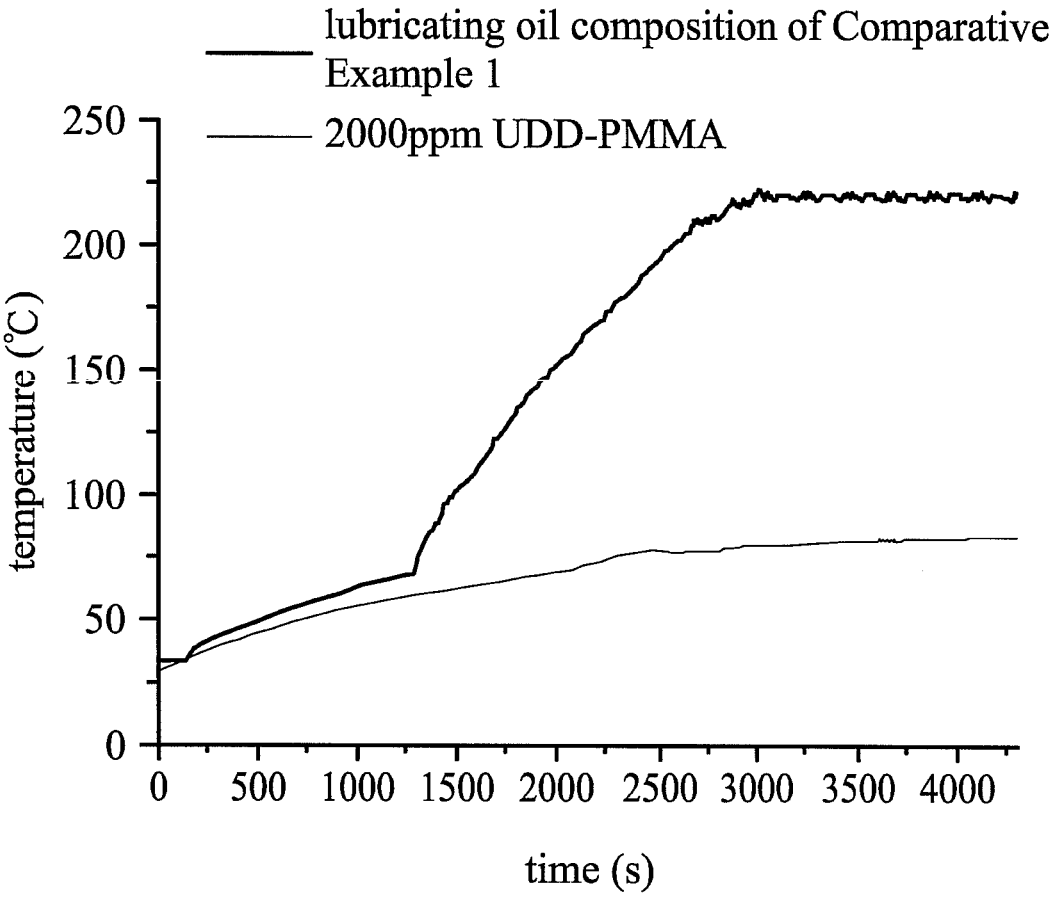
FIG. 11 is a graph plotting temperature of oil against operation time of the lubricating oil compositions as disclosed in the Comparative Example 1 and Example 4 (with a UDD-PMMA concentration of 2000 ppm).

FIG. 10 is a graph plotting friction coefficient against operation time of the lubricating oil compositions as disclosed in the Comparative Example 1 and Example 4. FIG. 11 is a graph plotting temperature of oil against operation time of the lubricating oil compositions as disclosed in the Comparative Example 1 and Example 4. As shown in FIGS. 10 and 11, the lubricating oil composition of the Comparative Example 1 (with a surfactant) exhibited good lubricating properties at the beginning periods (between 0-1500 s). However, the lubricating ability of the lubricating oil composition was reduced as the time period increased, due to the decomposition of the surfactant. In the later periods (3500 s and thereafter), the lubricating oil compositions as disclosed in the Comparative Example 1 exhibited poor lubricating properties, since the ultra dispersed diamonds re-aggregated to a coagulum with micro sizes.

To the contrary, since the lubricating oil composition of the disclosure included the organic-inorganic composite particle which can be uniformly dispersed in the base lubricant oil in the absence of the surfactant, the lubricating oil composition of the disclosure exhibited improved lubricating properties and excellent thermal stability.

In comparison with conventional lubricating oil compositions employing a surfactant (or dispersant), the lubricating oil composition of the disclosure has the advantages of:

1. The range of selection of a base lubricant oil for the lubricating oil composition of the disclosure is wide, since the organic-inorganic composite particle is apt to be uniformly dispersed in the base lubricant oil such as gear oil, cutting oil, or grease.

2. Since the organic-inorganic composite particles have long-term stability and thermal stability, the lubricating oil composition of the disclosure exhibits excellent lubricating properties and does not re-aggregate to a coagulum after long periods of operation.

3. Since the lubricating oil composition of the disclosure consists of a base lubricant oil and an organic-inorganic composite particle, there is no additional surfactant or dispersant add, which detrimentally affects friction properties.

While the disclosure has been described by way of example and in terms of the preferred embodiments, it is to be understood that the disclosure is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A lubricating oil composition, comprising:

a base lubricant oil; and an organic-inorganic composite particle uniformly dispersed in the base lubricant oil, wherein the organic-inorganic composite particle comprises a nanodiamond particle, and polymeric chains are grafted on a graphite layer surface of the nanodiamond particle.

2. The lubricating oil composition as claimed in claim 1, wherein the polymeric chains have a weight percentage of between 4% and 50%, based on the weight of the organic-inorganic composite particle.

3. The lubricating oil composition as claimed in claim 1, wherein the organic-inorganic composite particle has a weight percentage of between 0.01% and 2%, based on the total weight of the lubricating oil composition.

4. The lubricating oil composition as claimed in claim 1, wherein the organic-inorganic composite particle has an average particle size of 10-250 nm.

5. The lubricating oil composition as claimed in claim 1, wherein the base lubricant oil comprises mineral oil, gear oil, semi-synthetic oil, synthetic oil, cutting oil, grease, or combinations thereof.

6. The lubricating oil composition as claimed in claim l, wherein the polymeric chain comprises a hydrophobic polymeric chain.

7. The lubricating oil composition as claimed in claim 1, wherein the polymeric chain comprises polymethyl methacrylate (PMMA), polyglycidyl methacrylate (PGMA), polystyrene (PS), or combinations thereof.

8. A method for preparing a lubricating oil composition, comprising:

mixing a nanodiamond particle with a monomer, thereby obtaining a first mixture;

subjecting the first mixture to a de-aggregation and polymerization process, thereby obtaining a nanodiamond particle with the polymeric chains grafted on a graphite layer surface of the nanodiamond particle;

mixing the nanodiamond particle with the polymeric chains grafted on the graphite layer surface of the nanodiamond particle with a base lubricant oil, obtaining a second mixture; and subjecting the second mixture to a dispersion process.

9. The method as claimed in claim 8, wherein the dispersion process comprises ultrasonic vibration, ball-milling processes, or combinations thereof.

10. The method as claimed in claim 8, wherein the de-aggregation process comprises a wet ball-milling process.

11. The method as claimed in claim 8, wherein the nanodiamond particle with the polymeric chains grafted on a surface of the nanodiamond particle has a weight percentage of between 0.01% and 2%, based on the total weight of the lubricating oil composition.

12. The method as claimed in claim 8, wherein the nanodiamond particle with the polymeric chains grafted on a surface of the nanodiamond particle has an average particle size of 10-250 nm.

13. The method as claimed in claim 8, wherein the base lubricant oil comprises mineral oil, gear oil, semi-synthetic oil, synthetic oil, cutting oil, grease, or combinations thereof.

14. The method as claimed in claim 8, wherein the polymeric chain comprises a hydrophobic polymeric chain.

15. The method as claimed in claim 8, wherein the polymeric chain comprises polymethyl methacrylate (PMMA), polyglycidyl methacrylate (PGMA), polystyrene (PS), or combinations thereof.

* * * * *

UNITED STATES PATENT AND TRADEMARK OFFICE

CERTIFICATE OF CORRECTION

PATENT NO. : 8,658,578 B2
APPLICATION NO. : 13/151041
DATED : February 25, 2014
INVENTOR(S) : Yi-Lin Hsin et al.

It is certified that error appears in the above-identified patent and that said Letters Patent is hereby corrected as shown below:

Title page, item (30) change "Dec. 29, 2010 (CN)...2010 1 0623959" to -- Dec. 29, 2010 (CN)...201010623959.2 --

Signed and Sealed this
Seventeenth Day of June, 2014

Michelle K. Lee

Michelle K. Lee
*Deputy Director of the United States Patent and Trademark Office*